US005650112A

United States Patent [19]

Zikeli et al.

[11] Patent Number: 5,650,112

[45] Date of Patent: Jul. 22, 1997

[54] PROCESS OF MAKING CELLULOSE FIBERS

[75] Inventors: Stefan Zikeli, Regau; Friedrich Ecker, Timelkam; Ernst Rauch, Schörfling, all of Austria

[73] Assignee: Lenzing Aktiengesellschaft, Austria

[21] Appl. No.: 219,617

[22] Filed: Mar. 29, 1994

[30] Foreign Application Priority Data

Jul. 28, 1993 [AT] Austria ..... 1497/93

[51] Int. Cl.[6] ..... D01F 2/24

[52] U.S. Cl. ..... 264/187; 264/211.14; 264/211.16; 264/237

[58] Field of Search ..... 264/187, 203, 264/211.14, 211.16, 237

[56] References Cited

U.S. PATENT DOCUMENTS

| | | | |
|---|---|---|---|
| 1,933,587 | 11/1933 | Dreyfus et al. . | |
| 1,934,618 | 11/1933 | Briggs et al. . | |
| 2,131,810 | 10/1938 | Kinsella et al. . | |
| 2,179,181 | 11/1939 | Graenacher et al. | 106/203 |
| 2,222,797 | 11/1940 | Dreyfus . | |
| 2,284,028 | 5/1942 | Ubbelohde | 264/143 |
| 3,118,012 | 1/1964 | Kilian | 264/211.14 |
| 3,299,469 | 1/1967 | Charlton . | |
| 3,619,452 | 11/1971 | Harrison et al. | 264/211.14 |
| 3,824,050 | 7/1974 | Balk | 425/72.2 |
| 3,836,346 | 9/1974 | Stalego . | |
| 3,858,386 | 1/1975 | Stofan . | |
| 3,969,462 | 7/1976 | Stofan . | |

(List continued on next page.)

FOREIGN PATENT DOCUMENTS

| | | | |
|---|---|---|---|
| 1135918 | 11/1993 | Canada . | |
| 1040482 | 11/1981 | European Pat. Off. . | |
| 1050483 | 1/1984 | European Pat. Off. . | |
| 105169 | 4/1984 | European Pat. Off. . | |
| 494852 | 7/1992 | European Pat. Off. . | |
| 356419 | 12/1992 | European Pat. Off. . | |
| 898802 | 10/1993 | France . | |
| 2830685 | 2/1979 | Germany . | |
| 2844163 | 5/1979 | Germany . | |
| 3406346 | 10/1984 | Germany . | |
| 218121 | 1/1985 | Germany . | |
| 57-161113 | 3/1981 | Japan | 264/211.14 |
| 61-119704 | 6/1986 | Japan | 264/211.14 |
| 807248 | 1/1959 | United Kingdom . | |
| 957534 | 5/1964 | United Kingdom | 264/211.14 |
| 17855 | 6/1964 | United Kingdom . | |
| WO93/13670 | 7/1993 | WIPO . | |
| WO93/19230 | 9/1993 | WIPO | 264/187 |

OTHER PUBLICATIONS

English language abstract of German Patent No. 218 121.
English language abstract of German Patent No. 3 406 346.
English language abstract of Japanese Patent No. 57–161113.
English language abstract of Japanese Patent No. 61–119704.
English language abstract of European Patent No. 105 169.
English language abstract of European Patent No. 356 419.
English language abstract of European Patent No. 494 852.
English language abstract of Austrian Patent Application No. 2724/89.

*Primary Examiner*—Leo B. Tentoni
*Attorney, Agent, or Firm*—Brumbaugh, Graves, Donohue & Raymond

[57] ABSTRACT

The spinneret according to the invention is especially suitable for spinning cellulose solutions and has a die body which is essentially rotationally symmetrical having an inlet in its centre for cooling gas, an inlet for cellulose solutions, an annular deep-drawn spinning insert of precious metal with spinning holes wherein the spinning insert is designed pan-shaped in cross-section, and a baffle plate to deflect the cooling gas stream through the cellulose filaments which are extruded from the spinning holes, so that the cooling gas stream strikes the extruded cellulose filaments essentially at right angles. The spinning holes in the spinning insert are uniformly spaced from one another.

10 Claims, 1 Drawing Sheet

U.S. PATENT DOCUMENTS 3,976,411 8/1976 Rahlfs et al. .
3,996,321 12/1976 Weinberger .
4,038,357 7/1977 Boyes et al. .
4,078,034 3/1978 Lewis .
4,080,143 3/1978 Upmeier .
4,115,048 9/1978 Alderfer et al. .
4,144,080 3/1979 McCorsley, III ..... 106/186
4,145,391 3/1979 Rodier .
4,261,943 4/1981 McCorsley, III ..... 264/187 X
4,285,646 8/1981 Waite .
4,305,703 12/1981 Lupke et al. .
4,340,559 7/1982 Yang .
4,440,711 4/1984 Kwon et al. ..... 264/185
4,526,597 7/1985 Olinger et al. .
4,601,649 7/1986 Upmeier .
4,643,750 2/1987 Glaser .
4,712,988 12/1987 Broaddus et al. .
4,713,290 12/1987 Kwon et al. ..... 428/364
4,804,511 2/1989 Pieper et al. .
4,836,507 6/1989 Yang .
4,838,774 6/1989 Balk .
4,850,836 7/1989 Maeda et al. .
4,990,297 2/1991 Stibul et al. .
5,094,690 3/1992 Zikeli et al. ..... 106/198
5,230,905 7/1993 Fare et al. .
5,252,284 10/1993 Jurkovic et al. ..... 264/187
5,254,303 10/1993 Ostertag et al. .

PROCESS OF MAKING CELLULOSE FIBERS

BACKGROUND OF THE INVENTION

The present invention concerns a spinneret for spinning cellulose solutions.

It is known from U.S. Pat. No. 2,179,181 that tertiary amine-oxides are capable of dissolving cellulose and that cellulose fibres can be obtained from these solutions by precipitation. A process for the preparation of such solutions is known for example from EP-A 0 356 419. According to this publication, a suspension of cellulose is firstly prepared in aqueous tertiary amine-oxide. The amine-oxide contains up to 40 weight % water. The aqueous cellulose suspension is heated and water is removed under reduced pressure until the dissolves. The process is carried out in a specially-developed stirring device which can be evacuated.

When preparing cellulose fibres, it is known from DE-A 2 844 163 that an air gap can be located between the spinning die, ie, the spinneret, and the precipitation bath to achieve drawing at the die. This drawing at the die is necessary because drawing of the fibres becomes very difficult after contact of the shaped spinning solution with the aqueous precipitation bath. The fibre structure which is set in the air gap is fixed in the precipitation bath.

A process of the type mentioned at the start is known from DE-A 2 830 685, wherein a solution of cellulose in a tertiary amine-oxide is shaped in hot condition to give filaments which are cooled with air and then introduced into a precipitation bath in order to precipitate the dissolved cellulose. The surface of the spun fibres is also wetted with water to reduce their tendency to adhere to neighbouring fibres.

It has been shown that all processes in the prior art concerning the formation of filaments and the textile properties of the fibres are unsatisfactory. On account of the small spinning gap between the spinneret and the precipitation bath, which is in the region of a few centimeters, and the short period of time available in which the properties of the fibre can be adjusted, it is difficult to achieve for instance a uniform titre and a uniform strength and elongation for all the filaments in the fibre bundle and for the fibres obtained after precipitation. This particularly occurs when spinning is carried out at high capacity, ie, at high fibre density.

SUMMARY OF THE INVENTION

This is the starting point of the invention, which thus has the objective of improving the spinning process so that the above difficulties are overcome and so that a dense fibre bundle can be spun and despite this the textile properties of the spun fibres can be better adjusted.

Extensive tests have shown that this objective can be attained with a specially designed spinning device. The spinneret according to the invention for spinning cellulose solutions has a die body which is largely rotationally symmetrical with an inlet in its centre for cooling gas, an inlet for cellulose solutions, an annular deep-drawn spinning insert of precious metal which is boat-shaped in cross-section with spinning holes which are arranged at a constant distance from one another, and also a baffle plate for deflecting the cooling gas stream onto the cellulose filaments which are extruded from the spinning holes so that the stream of cooling gas strikes the cellulose filaments essentially at right angles.

The textile properties of the fibres can be affected by blowing an inert gas, preferably air, through them. The cooling process of the filaments emerging from the spinneret affects not only the fibre quality but also the drawing and the elongation of the filaments. Thus fibres with uniform properties can be prepared when a stream of cooling gas is blown through the freshly extruded filaments; the gas stream should exhibit as little turbulence as possible, ie, it should exhibit substantially laminar flow.

The present invention is based on the finding that this process can be further improved when the spinning device used is designed in such a way that the flow of cooling gas remains as laminar as possible even when passing through the fibre bundle, ie, when cooling the freshly extruded cellulose filaments. This is assured when the spinning holes are arranged so that they have a uniform distance from one another. In this way it is also possible to spin filaments using hole densities greater than 3.9 holes per $mm^2$ without adhesion occurring between individual filaments.

A preferred embodiment of the spinneret according to the invention is characterised in that it contains a spinning insert whose spinning holes are arranged on at least three concentric circles at a constant distance from one another, whereby when viewed radially the spinning holes on the concentric circles are best arranged in the interstices. This permits an especially uniform temperature to be maintained in the spinning process, thus allowing uniform cooling of the filaments to be achieved which has an advantageous effect on the properties of the cellulose fibres.

An especially preferred embodiment of the spinneret according to the invention has a spinning insert with at least 0.48 spinning holes per $mm^2$. An alloy of gold and platinum has proved to be the best material for the spinning insert.

The invention also concerns the use of the spinneret according to the invention for spinning solutions of cellulose in a tertiary amine-oxide, whereby N-methylmorpholine-N-oxide is advantageously used as tertiary amine-oxide.

BRIEF DESCRIPTION OF THE DRAWINGS

The process according to the invention is still further explained by means of the Drawings, wherein FIG. 1 schematically shows a cross-section of an embodiment of the spinneret according to the invention and FIG. 2 schematically shows a section on an enlarged scale of the annular spinning insert with the spinning holes.

DESCRIPTION OF THE PREFERRED EMBODIMENTS

Figure 1:
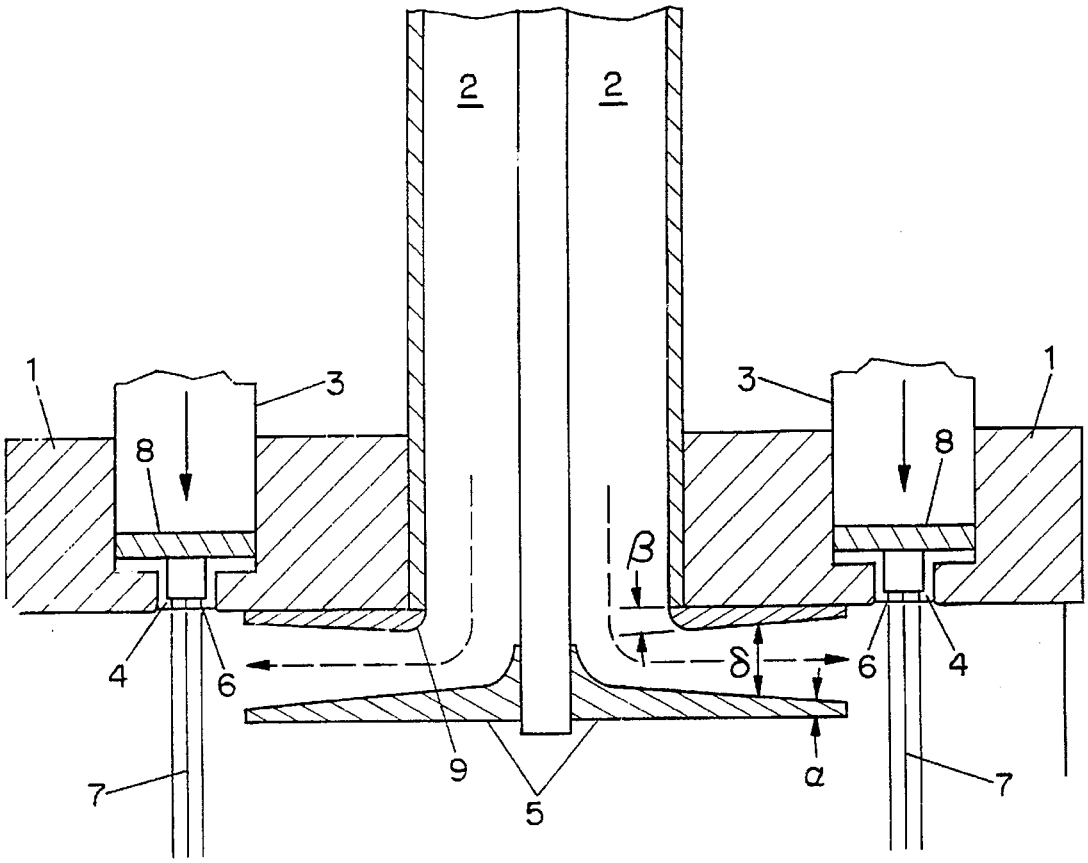

FIG. 1 shows a heatable spinneret die body (1) [the heating is not shown] which is supplied through an inlet (3) with spinning material, ie, hot cellulose solution at a temperature of about 100° C. (shown schematically in FIG. 1 with an arrow). The annular deep-drawn spinning insert is (4) and the spinning holes are (6). This spinning insert (4) is designed pan-shaped and is inset into the die body which is shaped correspondingly in steps in order to carry the spinning insert (4).

Figure 2:
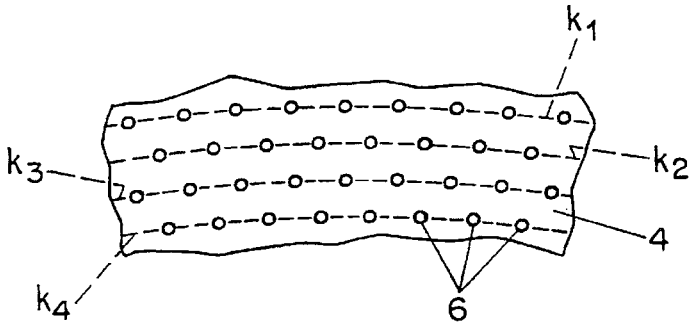

For better understanding, a section of the spinning insert (4) is shown schematically in FIG. 2 with a view against the direction of spinning. In FIG. 2 spinning holes (6) are shown which are located on four circles $k_1$, $k_2$, $k_3$ and $k_4$. In the radial direction, the spinning holes are arranged in the interstices and are uniformly spaced from one another.

An exemplary embodiment of such a spinning insert (4) consists of an alloy of 70% gold and 30% platinum, has a diameter of 135 mm, is 1 mm thick and the drilled annular part has a width of 15 mm. The distance between the holes is uniform at 0.50 mm and the holes are drilled in the interstices in 19 series of holes. In this way more than 15,000 spinning holes can be accommodated.

Above the spinning insert (4) there is a filter ring (8); this filter ring (8) and the spinning insert (4) are suitably sealed against the die body (not shown).

The inlet (3) for the spinning material can have an annular design. It is also possible however to feed the die body (1) with spinning material at just one point provided that the die body is designed so that spinning material can be uniformly distributed over the whole spinning insert (4).

The fibre bundle (7) is extruded from the spinning holes (6). The fibre bundle (7) passes across an air gap, which is defined by the distance of the spinning holes (6) from the surface of the precipitation bath (not shown), then passes into the precipitation bath and is drawn. The extruded fibre bundle (7) is cooled with air which is shown schematically in the Figure with an hyphenated arrow. Drawing is achieved by drawing off the fibre bundle (7) at a greater velocity than that at which it leaves the spinning holes (6).

The cooling gas which is preferably air is blown in at the inlet (2), strikes the baffle plate (5) and is deflected in an essentially horizontal direction. A laminar air stream is blown from the inside to the outside through the dense annular fibre bundle (7) which is thereby cooled. The cooling air thus emerges from a annular slit-die which is formed by the baffle plate (5) and the opposing face (9).

The angles drawn into FIG. 1 preferably have the following values:

$\alpha$ (baffle plate): $\leqq 12°$, preferably: 3°–8°;

$\beta$ (upper guiding face): $\leqq 10°$, preferably: 4°–8°;

$\sigma$ ($\alpha+\beta$): $\leqq 22°$.

Insulation (not shown) is preferably provided between the inlet (2) for cooling gas and the inlet (3) for spinning material to prevent heat transfer from the spinning material to the cooling air.

It has been shown that when using the arrangement of spinning holes according to the invention, having uniform hole-to-hole distance, the gas stream is subjected to practically no formation of turbulence during its passage through the fibre bundle, which has a positive effect on the whole spinning process and on the properties of the resulting cellulose fibres. If on the other hand the spinning holes are for example grouped together and are not uniformly spaced, so that there is no uniform hole-to-hole distance, then because of the existence of open spaces between the individual groups of fibre bundles, the cooling gas cannot flow through the fibre bundle without turbulence. This can adversely affect the spinning process.

The invention is still further explained by means of the following Examples.

EXAMPLE

A cellulose solution prepared in accordance with the process described in EP-A 0 356 419 was filtered and was spun in hot condition with the spinneret shown schematically in FIG. 1. The device has a pipe-shaped inlet (2) for cooling gas with an internal diameter of 44 mm and a baffle plate (5) with a diameter of 104 mm. The angles $\alpha$ and $\beta$ each amounted to 5°; the total opening angle $\sigma$ thus amounted to 10°.

In the Table the following are given:

the weight of cellulose solution spun/hr (kg/h), its composition (wt %), its temperature (°C.) during spinning, the width of the spinning insert (mm), the number of spinning holes, the hole density (number of holes/mm$^2$), the diameter of the spinning holes ($\mu$), the fibre draw ratio, the input of cooling air (m$^3$/h), the temperature of the cooling air (°C.), the temperature of the effluent internal cooling air (°C.), the NMMO content of the precipitation bath (wt % NMMO), and the end titre (dtex) of the fibre prepared.

TABLE

| | |
|---|---|
| Cellulose solution (kg/h) | 27.6 |
| Cellulose content (wt %) | 15 |
| Temp. of cellulose soln. (°C.) | 117 |
| Width of the spinning insert | 15 |
| Number of spinning holes | 15,048 |
| Hole density (holes/mm$^2$) | 3.94 |
| Hole diameter ($\mu$m) | 100 |
| Fibre draw ratio | 14.5 |
| Cooling air (m$^3$/h) | 34.8 |
| Temp. of cooling air fed | 21 |
| Temp. of cooling air removed | 36 |
| Precipitation bath (% NMMO) | 20 |
| Precipitation bath temperature | 20 |
| Minimal fibre titre (dtex) | 1.18 |

We claim:

1. A method for spinning solutions of cellulose in a tertiary amine-oxide using a spinneret comprising an essentially rotationally symmetrical die body, the die body including an inlet for cooling gas at the center of the die body, an inlet for cellulose solutions located on the top portion of the die body, an annular deep-drawn insert of precious metal located in the inlet for cellulose solutions having spinning holes arranged at a constant distance from one another wherein the insert has a boat-shaped cross-section, and a baffle plate for deflecting the cooling gas stream through cellulose filaments extruded from the spinning holes such that the cooling gas stream strikes the extruded cellulose filaments essentially at right angles, said method comprising the steps of:

supplying a solution of cellulose in a tertiary amine-oxide to the inlet for cellulose solutions;

conducting the solution of cellulose through the annular deep-drawn insert;

extruding cellulose filaments from the spinning holes;

striking the extruded cellulose filaments with a cooling gas stream directed at a right angle to the extruded cellulose filaments; and introducing the extruded cellulose filaments into a precipitation bath.

2. The method of claim 1 wherein the spinning holes are arranged so as to form at least three concentric circles.

3. The method of claim 2 wherein the spinning holes arranged to form concentric circles are arranged such that spinning holes on a circle are located in the interstices of any radially directed plane which includes the spinning holes of an adjacent circle.

4. The method of claim 1, claim 2 or claim 3 wherein the annular deep-dawn insert has at least 0.48 holes per square millimeter.

5. The method of claim 1, claim 2 or claim 3 wherein the spinning insert comprises a gold/platinum alloy.

6. The method of claim 5 wherein the spinning insert comprises a gold/platinum alloy.

7. The method of claim 1, claim 2, or claim 3 wherein the tertiary amine-oxide is N-methylmorpholine-N-oxide.

8. The method of claim 4 wherein the tertiary amine-oxide is N-methylmorpholine-N-oxide.

9. The method of claim 5 wherein the tertiary amine-oxide is N-methylmorpholine-N-oxide.

10. The method of claim 6 wherein the tertiary amine-oxide is N-methylmorpholine-N-oxide.

* * * * *

UNITED STATES PATENT AND TRADEMARK OFFICE

CERTIFICATE OF CORRECTION

PATENT NO. : 5,650,112

DATED : July 22, 1997

INVENTOR(S) : Zikeli et al.

It is certified that error appears in the above-identified patent and that said Letters Patent is hereby corrected as shown below:

Title page, under "Other Publications", insert --Dr. Andrzej Zachara, How to Estimate the Flow Characteristics in Multifilament Spinning Part II, Fiber World, pg.s 52-61 (July 1987)--;

Col. 1, lines 16-17, "until the dissolves" should read --until the cellulose dissolves--; and, Col. 4, line 64, "claim 5" should read --claim 4--.

Signed and Sealed this

Thirteenth Day of January, 1998

Bruce Lehman

*Attest:*

BRUCE LEHMAN

*Attesting Officer*

*Commissioner of Patents and Trademarks*